United States Patent [19]

Marx

[11] Patent Number: 4,761,961

[45] Date of Patent: Aug. 9, 1988

[54] PROCEDURE FOR REMOVAL OF LOW-BOILING REFRIGERANTS FROM REFRIGERATIVE AND AIR-CONDITIONING UNITS

[75] Inventor: Bodo Marx, Willich, Fed. Rep. of Germany

[73] Assignee: Messer, Griesheim GmbH, Fed. Rep. of Germany

[21] Appl. No.: 55,505

[22] Filed: May 29, 1987

[30] Foreign Application Priority Data

Jul. 3, 1986 [DE] Fed. Rep. of Germany ..... 3622423

[51] Int. Cl.[4] ..... F17C 7/02

[52] U.S. Cl. ..... 62/55; 62/77; 62/292

[58] Field of Search ..... 62/55, 77, 292

[56] References Cited

U.S. PATENT DOCUMENTS

| | | | |
|---|---|---|---|
| 2,482,778 | 9/1949 | Joerren | 62/55 |
| 2,488,813 | 11/1949 | Garretson | 62/55 |
| 2,508,142 | 5/1950 | Brothman | 62/55 |
| 2,510,140 | 6/1950 | Rausch | 62/55 |
| 2,562,164 | 7/1951 | Hinkson | 62/55 |
| 2,896,420 | 7/1959 | Smouse | 62/77 |
| 3,443,392 | 5/1969 | Alexander | 62/77 |
| 3,491,544 | 1/1970 | Webber | 62/77 |

*Primary Examiner*—Ronald C. Capossela

*Attorney, Agent, or Firm*—Connolly & Hutz

[57] ABSTRACT

Low-boiling refrigerants are removed from refrigerative and air-conditioning units by decantation into collecting vessels. The vessels are cooled throughout the entire removal process by heat exchanger with a cryogenic coolant to below the boiling temperature of, and within the ambient pressure conditions of, the refrigerant.

8 Claims, 2 Drawing Sheets

PROCEDURE FOR REMOVAL OF LOW-BOILING REFRIGERANTS FROM REFRIGERATIVE AND AIR-CONDITIONING UNITS

BACKGROUND OF THE INVENTION

In air-conditioning and refrigerative units, fluorine hydrocarbons and very often ammonia are employed as the coolants, the boiling-points of which may lie considerably below 0° C., depending on whatever their chemical composition happens to be, and ambient pressure. Thus, for example, the boiling point of $CF_2Cl_2$ is −29.8° C., and that of $CF_3Cl$, −81.5° C. During maintenance and repair operations, refrigerants need to be decanted from their units. For this purpose, refrigerants under pressure are gathered in steel cylinders. After closing the cylinder valve, a residual amount of the refrigerant will remain behind in the unit which cannot be collected and thus is released into the atmosphere. This means of course that a part of the refrigerant is lost, and, in addition, certain coolants are of a nature which makes them a hazard to the environment.

SUMMARY OF INVENTION

The invention thus sets itself the object of creating a procedure and a device for removal of low-boiling refrigerants from refrigerative and air-conditioning units in order to make possible a practically loss-free economical collection of refrigerants.

For carrying out the procedure of the invention, the cooled collecting vessel is attached to the decantation studs of the air-conditioning or refrigerative unit by a connective pipe. As soon as all the valves in the connective pipe between the collecting vessel and the unit are opened, the pressure in the unit will be transferred to the collecting vessel. Inasmuch as the collecting vessel is cooled, however, the pressure in the collecting vessel will subside. Because of the difference in pressure between the unit and the collecting vessel, the low-boiling refrigerant enters the collecting vessel in either gaseous or liquid state. Under such a circumstance, the inflowing liquid will be cooled, and thus the vapor pressure is kept low. The entering gas becomes thoroughly condensed. As a consequence, the refrigerant may be drawn off from the unit with practically no residue left behind.

A further advantage of the procedure of the invention is that it may be employed effectively also if decantation by means of traditional pumps is impossible because of cavitation.

The device for practicing the procedure of the invention may be in the form of a mobile appliance with storage unit for the cryogenic refrigerant. An electrical impulse is not requisite, and deployment is possible in non-protected areas. With one solitary cooling device, several collecting vessels in succession may be cooled. The decantation periods are brief. In the instance of large amounts of refrigerant, a graduated removal is likewise possible. The procedure of the invention is not limited to decantation of refrigerative and air-conditioning units, but may be deployed wherever agents with qualified, assured physical data should be collected confidently and without loss, e.g., the aerosols from the supply systems of nuclear power plants.

THE DRAWINGS

DETAILED DESCRIPTION

Figure 1:
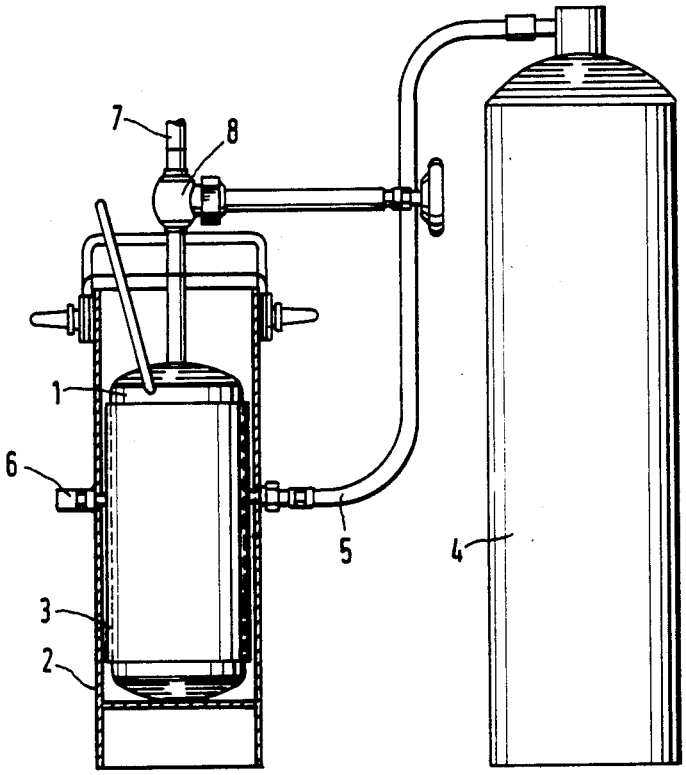
FIG. 1 is a schematic elevation view of a collecting vessel that is cooled by $CO_2$ dry ice.

The device shown in FIG. 1 consists of a collecting vessel 1 which is mounted in a scuttle 2. The collecting vessel 1 is surrounded by a cooling sleeve containing $CO_2$ dry ice. Commercial $CO_2$ dry ice may be used for this purpose. In the device depicted, however, the dry ice is manufactured on the spot by allowing $CO_2$ from the compression gas cylinder 4 to expand into the cooling sleeve 3 by way of the connecting pipe 5. The valve 6 is used for relaxing the pressure. The collecting vessel 1 is attached to the unit to be decanted by the connective pipe 7.

As soon as the shutoff valve 8 is opened, the pressure of the refrigerant contained in the unit involved the collecting vessel 1. The refrigerant flows into the collecting vessel 1, however, only if the cooling sleeve 3 has been treated with $CO_2$ dry ice. The cooling of the collecting vessel 1 by the cooling sleeve 3 causes a partial vacuum in the collecting vessel 1, by means of which the entire liquid refrigerant is drawn from the unit. Finally, the remaining gaseous refrigerant will condense, down to a slight remnant in the collecting vessel 1, which acts like a cryopump. At the conclusion, the shutoff valve 8 is closed, and the collecting vessel 1 is separated from the connective pipe 7. The unit may now be maintained or repaired.

Figure 2:
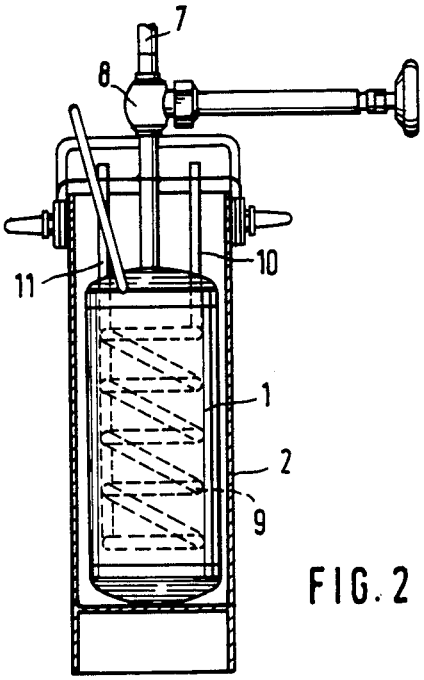
FIG. 2 illustrates a collecting vessel equipped with a condensing coil in its interior which is circulated with supercooled nitrogen.

FIG. 2 shows a device which is especially suited for removing refrigerant with a very low boiling temperature. The collecting vessel 1 and the scuttle 2 are in this instance retained without modification, as are also the connective pipe 7 and the shutoff valve 8. Cooling takes place however by means of a condensing coil 9 in the interior of the collecting vessel 1, equipped with an intake 10 and an exhaust 11 for the cyrogenic refrigerant. Cold nitrogen gas or even liquid nitrogen may be employed as the cryogenic refrigerant.

Figure 3:
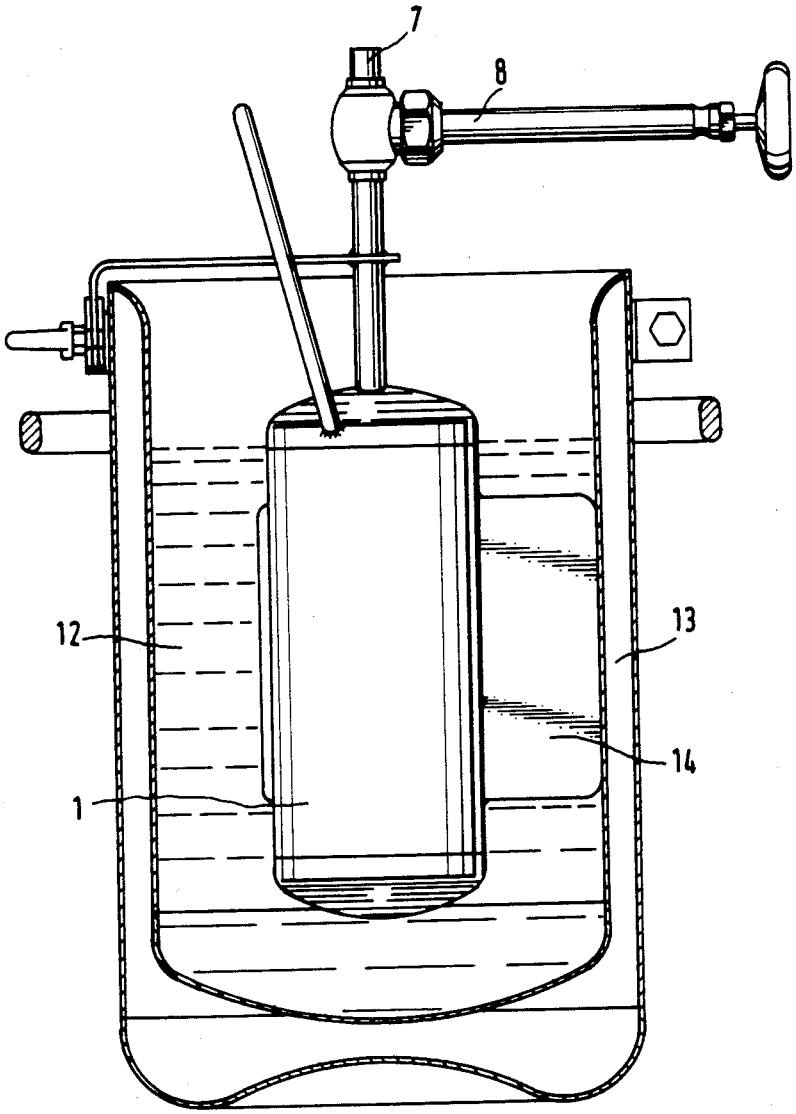
FIG. 3 is a cross-sectional view of a collecting vessel cooled by a bath of liquid nitrogen.

FIG. 3 shows finally a form of construction in which the collecting vessel 1 is cooled by a bath 12 composed of liquid nitrogen. The connective pipe 7 is retained, together with the shutoff valve 8. However, in place of the scuttle is a Dewar 13, which is filled with liquid nitrogen. The collecting vessel 1 is equipped with cooling flanges 14, which serve at the same time to mount it in the Dewar 13. This form of construction is likewise excellently suited for refrigerants and coolants with low boiling points.

SUMMARY

Occasionally, the low-boiling refrigerants need to be drawn off from refrigerative and air-conditioning units, as, for example, in order to conduct repair operations. The refrigerants are thus released under pressure into collecting vessels. However, a small amount of refrigerant will remain in the unit, which is removable by pressure release and rinsing of the pipe. In this manner, refrigerant is lost, and the natural environment is compromised. In order to tap the refrigerant without any loss, the collecting vessel 1 is cooled to such a great extent by a cryogenic coolant that the refrigerant becomes condensed as a result of the partial vacuum that appears in the collecting vessel (FIG. 1).

What is claimed is:

1. In a procedure for removal of low-boiling refrigerants from refrigerative and air-conditioning units by decantation into collecting vessels, the improvement being in that the collecting vessel undergoes cooling throughout the entire process of removal of the refrigerant by heat exchange with a cryogenic coolant to a temperature below the boiling temperature and within the ambient pressure conditions of the refrigerant.

2. Procedure according to claim 1, thereby characterized, in that the collecting vessel is being cooled by $CO_2$ dry ice.

3. Procedure according to claim 1, thereby characterized, in that the container is being cooled by supercold nitrogen.

4. Procedure according to claim 1, including mounting the collecting vessel in a carrying device which supports the collecting vessel, and creating communication between the collecting vessel and the unit by opening a closable valve in a pipe communicating with the collecting vessel and the unit to permit the refrigerant to be introduced into the collecting vessel.

5. In a device for removing low-boiling refrigerants from refrigerative and air-conditioning units by decantation into collective vessels, the improvement being in cooling means for cooling said collecting vessel throughout the removal procedure by heat exchange with a cryogenic coolant to a temperature below the boiling temperature and within the ambient pressure conditions of the refrigerant, said cooling means comprising a lowtemperature and pressure resistant collecting vessel with a closeable connection for introduction of the refrigerant, a carrying device for supporting said collecting vessel, and a cooling surface that is treatable by said cryogenic coolant.

6. Device, according to claim 5, thereby characterized, in that said carrying device is in the form of a scuttle said cooling surface being a cooling sleeve which surrounds said collecting vessel, and being equipped with connecting studs for a $CO_2$ compression gas cylinder and a pressure release valve.

7. Device according to claim 5, thereby characterized, in that said carrying device 4 is in the form of a scuttle, and said cooling surface is a condensing coil which is mounted inside said collecting vessel and which conducts a supercold gaseous nitrogen.

8. Device according to claim 5, thereby characterized, in that said carrying device is in the form of a Dewar, and said cooling surface is the outside wall of said collecting vessel that is provided with cooling flanges.

* * * * *